US005626368A

United States Patent [19]

St. Romain

[11] Patent Number: 5,626,368

[45] Date of Patent: May 6, 1997

[54] FILE FOLDER SYSTEM

[76] Inventor: Jeffrey H. St. Romain, 2025 Trinity Dr., Mandeville, La. 70448

[21] Appl. No.: 590,582

[22] Filed: Jan. 24, 1996

[51] Int. Cl.[6] ..... B42D 3/00

[52] U.S. Cl. ..... 281/29; 283/36

[58] Field of Search ..... 493/947; 281/29, 281/30, 31, 51, 45; 283/36–43; 40/359

[56] References Cited

U.S. PATENT DOCUMENTS

| | | | |
|---|---|---|---|
| 946,860 | 1/1910 | Multer . | |
| 3,494,637 | 2/1970 | Barrett et al. | 281/45 |
| 3,643,363 | 2/1972 | Biro | 40/359 |
| 4,715,621 | 12/1987 | Colavito et al. | 40/359 X |
| 5,135,261 | 8/1992 | Cusack et al. | 40/359 X |
| 5,174,606 | 12/1992 | Hure | 281/45 |

FOREIGN PATENT DOCUMENTS

| | | | |
|---|---|---|---|
| 477968 | 10/1951 | Canada | 40/359 |
| 2601627 | 1/1988 | France | 40/359 |

*Primary Examiner*—Willmon Fridie, Jr.
*Attorney, Agent, or Firm*—Joseph N. Breaux

[57] ABSTRACT

A file folder system including a file folder comprising a first and second folder member, foldably connected in a manner to create a storage space for paper records and the like between the first and second folder members; and a labeling tab extending from a perimeter edge one of the first and second folder members having an ink receiving surface disposed on an area thereof that will receive a quantity of ink thereon in a semi-permanent fashion and which ink is removable by wiping the ink receiving surface. The labeling tab may further include a flexible, transparent cover member that is normally disposed over the ink receiving surface to prevent inadvertent erasure of the labeling surface. The system may also include a conventional erasable ink pen. The erasable ink pen is preferably fitted with an eraser tip constructed or other suitable erasing material. In another aspect of the invention a notepad is provided on the interior surface of one of the first and second folder members comprising a second ink receiving surface area and a second flexible, transparent cover member normally disposed over the second ink receiving surface area.

6 Claims, 2 Drawing Sheets

FILE FOLDER SYSTEM

TECHNICAL FIELD

The present invention relates to filling systems for storing and retrieving records and more particularly to a filling system incorporating folders having tabs covered with a material suitible for receiving erasable ink markings thereon.

BACKGROUND ART

It is often desirable to maintain records in a file folder system for only a brief amount of time. Once the need to maintain the records has passed, the folder containing the records is either disposed of or reconfigured for holding new records by placing a new label over the previous lable or, in some folder systems, removing the old label from a transparent pocket and inserting a new label. Disposing of the used folder can be expensive and is wasteful in that the folder s generally still serviceable. Reconfiguring the used folder can be time consuming and with the high cost of labor and labels can sometimes be more expensive than simply disposing of the used folder. It would be desirable, therefore, to have a folder that had a labeling tab that could quickly and easily be marked to indicate the records contained within the folder. It would further be desirable if the labeling tab could be erased and relabeled numerous times without the annoying buildup of labels placed on top one another. It would also be desirable if the folder had an erasable notepad feature that allowed brief notes pertaining to the information or records contained within the folder to be left on a semi-permanent basis. The term "semi-permanent" is used herein to mean markings placed on a surface that can be entirely eliminated from the surface by erasing the surface but which will remain on the surface in the absence of an erasing act.

GENERAL SUMMARY DISCUSSION OF THE INVENTION

It is thus an object of the invention to provide a file folder that includes a labeling tab that is quickly and easily marked to indicate the records contained within the folder.

It a further object of the invention to provide a file folder that includes a labeling tab that is erasable.

It a further object of the invention to provide a file folder that includes a labeling tab that is erasable and that includes a transparent cover member attached to the perimeter of the erasable labeling tab and normally in a position covering the writing area of the erasable label.

It is a still further object of the invention to provide a file folder having an erasable notepad feature that has sufficient space on the erasable notepad to allow brief notes pertaining to the information or records contained within the folder to be left on a semi-permanent basis.

It is a still further object of the invention to provide a file folder that accomplishes all or some of the above objects in combination.

Accordingly, a file folder system is provided. The file folder of the system comprises a first and second folder member, foldably connected in a manner to create a storage space for paper records and the like between the first and second folder members; and a labeling tab extending from a perimeter edge one of the first and second folder members having an ink receiving surface disposed on an area thereof that will receive a quantity of ink thereon in a semi-permanent fashion and which ink is removable by wiping the ink receiving surface. The labeling tab may further include a flexible, transparent cover member that is normally disposed over the ink receiving surface to prevent inadvertent erasure of the labeling surface. The system may also include a conventional erasable ink pen. The erasable ink pen is preferably fitted with an eraser tip constructed from felt or other suitable erasing material.

In another aspect of the invention a notepad is provided on the interior surface of one of the first and second folder members comprising a second ink receiving surface area and a second flexible, transparent cover member normally disposed over the second ink receiving surface area.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
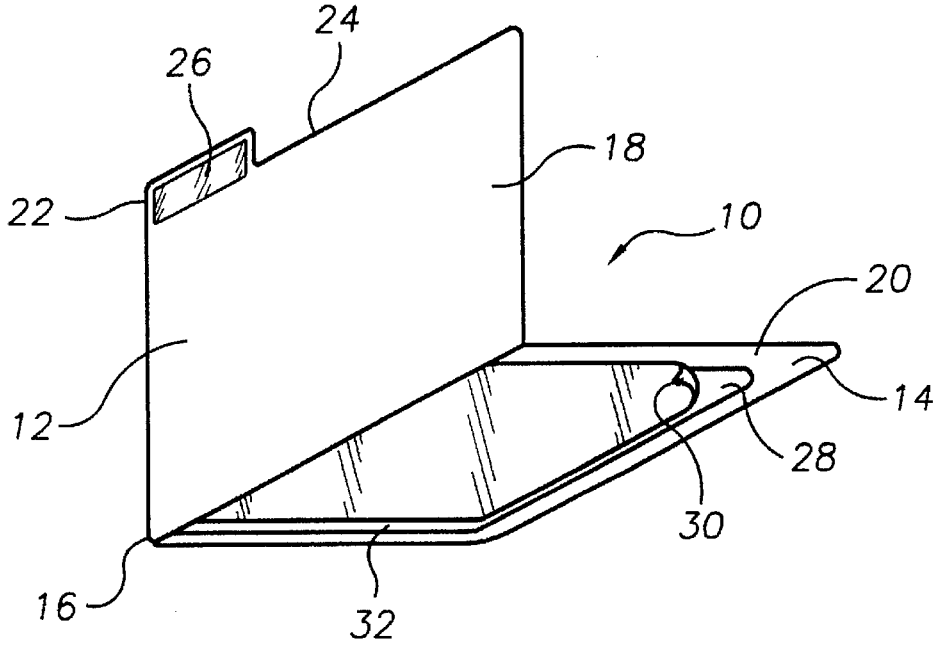
FIG. 1 is a perspective view of an exemplary embodiment of the file folder of the present invention showing the erasable notepad and erasable label.

FIG. 1 is a perspective view of an exemplary embodiment of the file folder of the present invention generally designated by the numeral 10. File folder 10 includes a first and second integrally formed folder member 2, 14, foldably connected along a fold section 16 in a manner to create a storage space for paper records and the like between a first facing surface 18 and a second facing surface 20. A labeling tab 22 extends from a top perimeter edge 24. A first ink receiving surface 26 is constructed by adhesively securing a rectangular section of vinyl sheeting to labeling tab 22.

A notepad ink receiving surface area 28 constructed from a second rectangular section of vinyl sheeting provided on second facing surface 20. Notepad ink receiving surface area 28 is covered by a transparent, flexible cover member 30 that has one edge 32 adhesively secured to second facing surface 20. Both first ink receiving surface 26 and notepad ink receiving surface area 28 are suitable for writing thereon with conventional erasable markers.

Figure 1A:
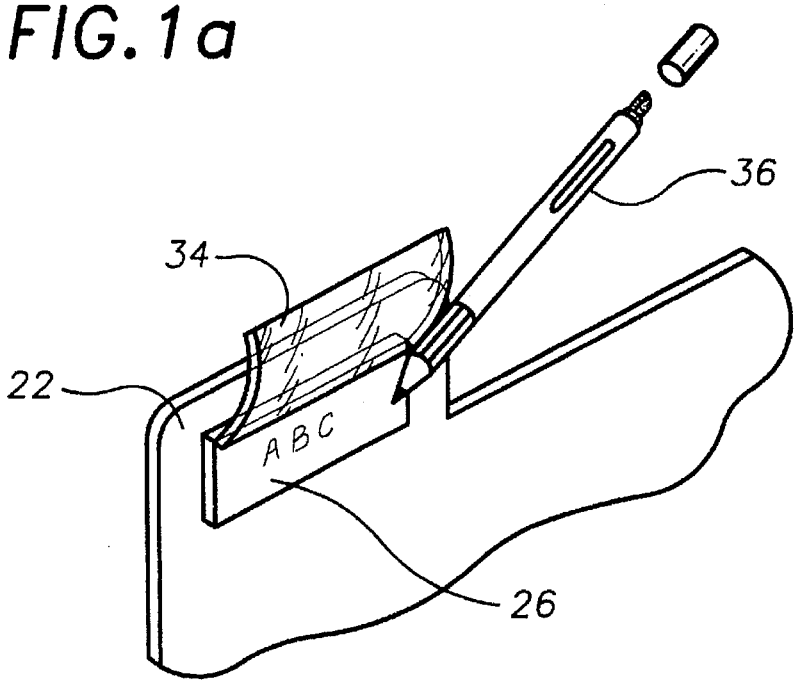
FIG. 1A is a detail perspective view of a preferred erasable label showing a flexible transparent cover member flexed out of its normal position covering the ink receiving surface and a representative erasable ink pen.

FIG. 1*a* is a detailed perspective view of a second exemplary labeling tab configuration. In this configuration, labeling tab 22 includes an identical first ink receiving surface 26 constructed from a rectangular section of vinyl sheeting adhesively secured to labeling tab 22 and a transparent, flexible label cover 34. Flexible label cover 34 is constructed from a transparent, flexible sheet of plastic film that is adhesively secured label tab 22 adjacent a top edge of first ink receiving surface 26. Also shown in the figure is a representative erasable ink pen 36 of the folder system of the present invention.

Figure 2:
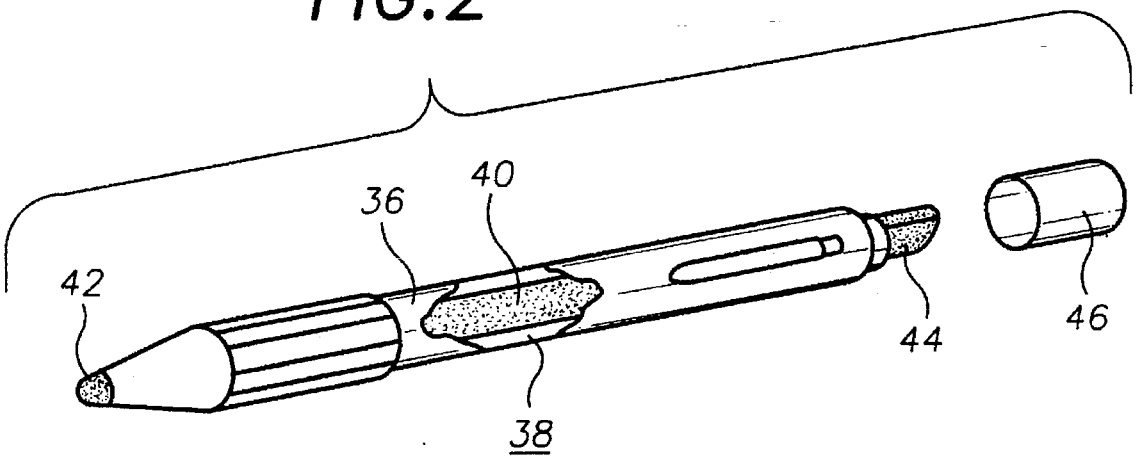
FIG. 2 is an exploded perspective view of an exemplary erasable ink pen of the present folder system.
Figure 3:
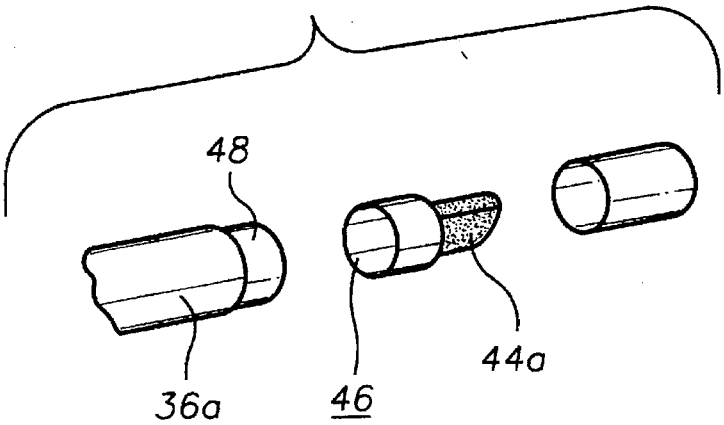
FIG. 3 is an exploded perspective view showing an exemplary add on eraser that may be used with a conventional erasable ink type pen.

FIG. 2 is an exploded perspective view of representative ink pen 36. Ink pen 36 includes an ink reservoir 38 having a porous wick member 40 in connection with a writing tip 42. A felt eraser 44 is provided at the end opposite writing tip 42. A cap member 46 is provided for covering felt eraser 44 when desired. FIG. 3 is a detail partially exploded view of a second representative erasable ink pen 36a to which an add on eraser 44a having a connecting aperture 46 for frictionally fitting over the end 48 of erasable ink pen 36*a*.

Use of the file system of the present invention is easy to understand and practice. Identifying information such as a reference file number and name may be written in erasable ink on first receiving surface 26 and flexible label cover 34 allowed to resiliently cover first receiving surface 26 to protect the writing from inadvertent erasure. In addition, if it is desired to make non-permanent notes in the file, notes, such as daytime phone numbers and vacation plans may be placed in the file folder by writing the note on notepad ink receiving surface area 28. Because notepad ink receiving surface area 28 is covered by transparent, flexible cover member 30, inadvertent erasure of the notes is prevented. Reconfigured of file folder 10 for a new use simply requires a quick erasure of the written material with an eraser 44, 44*a* or simply a cloth.

It can be seen from the preceding description that a file folder has been provided that includes a labeling tab that is quickly and easily marked to indicate the records contained within the folder; that includes a labeling tab that is erasable; that includes a transparent cover member attached to the perimeter of the erasable labeling tab and normally in a position covering the writing area of the erasable label; and that has an erasable notepad feature that has sufficient space on the erasable notepad to allow brief notes pertaining to the information or records contained within the folder to be left on a semi-permanent basis.

It is noted that the embodiment of the file folder system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed n accordance with the descriptive requirements of the law, it is to be understood that the details herein are to be interpreted as illustrative and not in a limiting sense.

What is claimed is:

1. A file folder system comprising:

a file folder comprising:

a first and second folder member, foldably connected in a manner to create a storage space between said first and second folder members; and a labeling tab extending from a perimeter edge, one of said first and second folder members having an ink receiving surface disposed on an area thereof that will receive a quantity of ink thereon in a semi-permanent fashion;

said file folder including a second ink receiving surface area disposed on an interior surface of one of said first and second folder members, and a second flexible, transparent cover member is secured to said file folder in a manner such that said transparent cover member is normally disposed over said second ink receiving surface area.

2. The file folder system of claim 1, wherein:

said labeling tab further includes a flexible, transparent cover member that is normally disposed over said ink receiving surface.

3. The file folder system of claim 1, further including:

an erasable ink pen.

4. The file folder system of claim 3 wherein:

said erasable ink pen is fitted with an eraser tip.

5. The file folder system of claim 3, wherein:

said labeling tab further includes a flexible, transparent cover member that is normally disposed over said ink receiving surface.

6. The file folder system of claim 5 wherein:

said erasable ink pen is fitted with an eraser tip.

* * * * *